US007861420B2

(12) United States Patent
Schwegler

(10) Patent No.: US 7,861,420 B2
(45) Date of Patent: Jan. 4, 2011

(54) CONCRETE FORM ALIGNMENT DEVICE

(76) Inventor: Al Schwegler, P.O. Box 31, Bloomington, NY (US) 12411

( * ) Notice: Subject to any disclaimer, the term of this patent is extended or adjusted under 35 U.S.C. 154(b) by 407 days.

(21) Appl. No.: 12/151,875

(22) Filed: May 9, 2008

(65) Prior Publication Data

US 2009/0278025 A1 Nov. 12, 2009

(51) Int. Cl.
*G01B 5/25* (2006.01)

(52) U.S. Cl. ..... 33/1 G; 33/645

(58) Field of Classification Search ..... 33/1 G, 33/1 H, 613, 645, 567, 573; 52/292
See application file for complete search history.

(56) References Cited

U.S. PATENT DOCUMENTS

| | | | | |
|---|---|---|---|---|
| 1,946,432 | A * | 2/1934 | Aldeborgh | 33/567 |
| 5,309,646 | A * | 5/1994 | Randolph et al. | 33/645 |
| 5,329,703 | A * | 7/1994 | Craig | 33/567 |
| 5,740,645 | A | 4/1998 | Raby | |
| 6,920,735 | B1 * | 7/2005 | Lambert et al. | 33/613 |
| 7,240,436 | B1 * | 7/2007 | Miller et al. | 33/613 |
| 2002/0095813 | A1 * | 7/2002 | Tatarnic | 33/613 |
| 2003/0121166 | A1 * | 7/2003 | Lin | 33/645 |

OTHER PUBLICATIONS

"Sonotube Concrete Forms," 2006 Sonoco Products Company, Hartsville, SC, USA, found htp://www.sonotube.com/, 1 page.
"Construction of the KOC Sustainable Living Centre," Post foundations 07 North post Sonotube alignment beams found http://www.sustainablebuilding2006.ca/gallery/main.php?g2_itemld=99, 2 pages.

* cited by examiner

*Primary Examiner*—G. Bradley Bennett
(74) *Attorney, Agent, or Firm*—Saile Ackerman LLC; Stephen B. Ackerman

(57) ABSTRACT

This invention provides a device and a method for aligning concrete forms. It relates to a device and a method which is used in conjunction with hollow, shaped concrete forms such as Sonotube forms in order to align, square and properly site said forms to produce optimally supported structures. The key advantage of this device and method are to eliminate the trial and error practice in the aligning of wood columns on top of concrete forms, to provide the ability to center or off-center posts accurately as required by the project design, to provide the ability to accurately set the hollow, shaped concrete forms for the proper elevation, for the correct location, and for the correct plumb level, and eliminate the need for batter boards or wooden edge forms which are placed outside of the project dimensions and used as inaccurate reference points for measuring the placement location of the hollow, shaped concrete forms along the edges of a project area.

20 Claims, 5 Drawing Sheets

4 Grooves
For 12", 10", 8", 6" Concrete Construction Tubes

CONCRETE FORM ALIGNMENT DEVICE

BACKGROUND OF THE INVENTION

1. Field of the Invention

This invention relates to a device and a method for aligning concrete forms. More particularly this invention relates to a device and a method which is used in conjunction with hollow, shaped concrete forms. An example of this type of hollow form is the Sonotube® concrete form (Sonoco Products Company, Hartsville, S.C.). These forms are used to form columns for structural support, in order to align, square and properly site such forms to produce optimally supported structures.

2. Description of Related Art

Current practice in the field of aligning columnar concrete forms used for structural support, and other purposes, involves a trial and error process. Much of the trial and error is caused by a lack of square edges for placing guide strings at the extreme corners of decks and other concrete support projects. Other uncertainty is caused by a lack of visibility to the centering of wood columns over the center of concrete cylinders and columns such as those produced with Sonotube forms and other similar technologies. Today's current practice includes inaccurate trial and error with respect to 1) setting the Sonotube forms for the proper elevation of the Sonotube forms, 2) setting the Sonotube forms for the correct location, and 3) setting the Sonotube forms for the correct plumb level. Also, current practice often dictates the use of batter boards or edge forms. Current practice has a need for batter boards or wooden edge forms which are placed outside of the project dimensions and used as inaccurate reference points for measuring the placement location of Sonotube forms along the edges of a project area.

U.S. Pat. No. 5,740,645—J-Bolt Form (Raby) describes an improved device for supporting and aligning anchor bolts within a light pole foundation mold. An outer ring having a downwardly projecting, circumferential lip which fits atop a Sonotube foundation mold.

BRIEF SUMMARY OF THE INVENTION

It is the objective of this invention to provide a device and a method for aligning concrete forms. It relates to a device and a method which is used in conjunction with Sonotube forms in order to align, square and properly site the forms to produce optimally supported structures.

The objects of this invention are achieved by a lid, a larger post-centering block with edge grooves, which is located on top of the lid, and a smaller post-centering block with edge grooves, which is located on top of the larger post-centering block. The concrete form alignment device uses a lid that has several concentric grooves on its bottom side. These concentric grooves fit over different sizes of concrete forms. The edge grooves in the post-centering blocks are used to align the concrete forms and to produce accurate right angles at a project's corners.

DETAILED DESCRIPTION OF THE INVENTION

Figure 1:
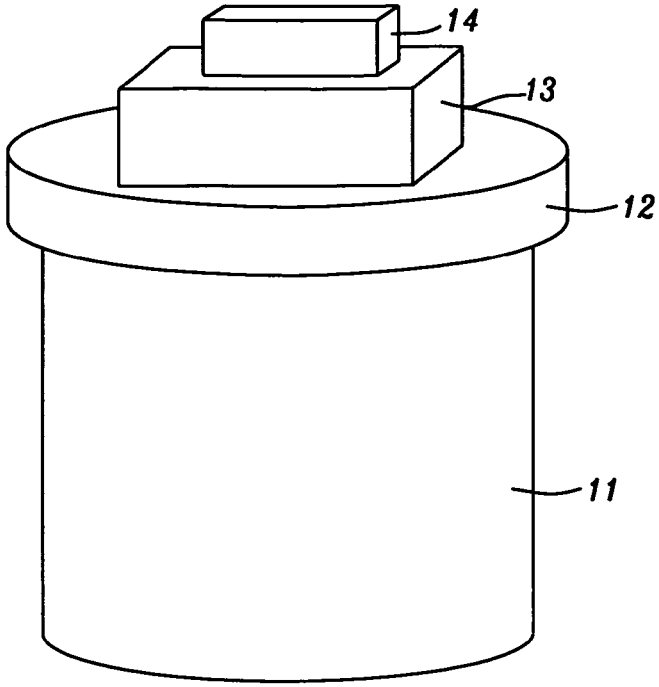
FIG. 1 shows the main embodiment on the invention on top of a cylindrical concrete form.
Figure 2A:
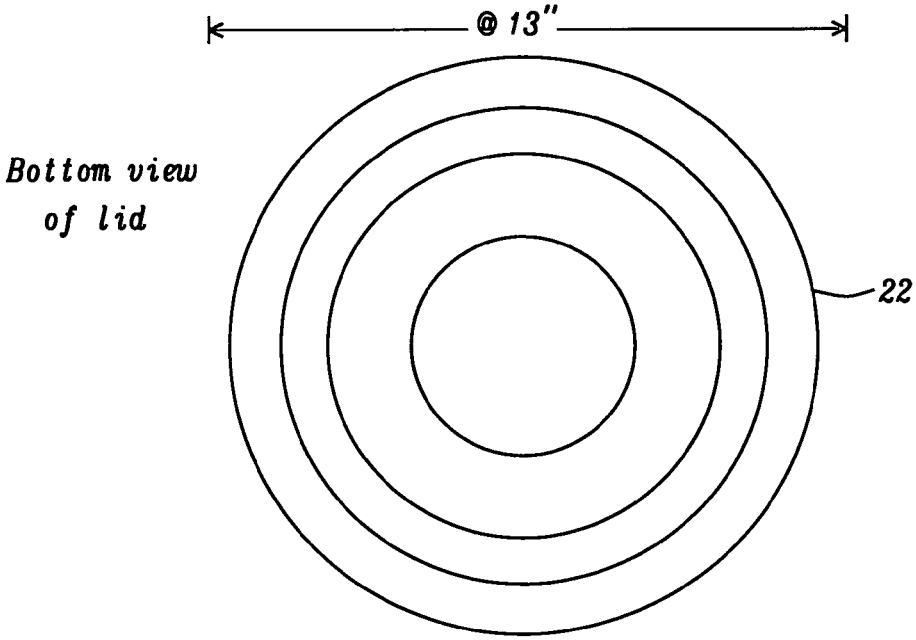
FIG. 2*a* is a bottom view of a lid adapter showing the concentric grooves of the invention.

FIG. 1 shows the main embodiment of the invention on top of a cylindrical concrete form 11. Such concrete forms typically are cylindrical in shape but could have other shapes as well. These concrete forms typically are formed of a fiber-based material, but could also be metal, fiberglass, or other materials. This embodiment includes a lip 12 made of plastic or similar material which fits over a Sonotube-type form 11. FIG. 2*a* shows the underside 22 of the lip 12 of FIG. 1, which provides for a plurality of circumference inserts which adapt to forms of different diameter. For example, Sonotube forms come in 12 inch, 10 inch, 8 inch and 6 inch diameters. FIG. 2*a* shows 4 concentric circular adapter grooves which fit over the four common sizes of Sonotube forms of 12 inch, 10 inch, 8 inch and 6 inch diameters. FIG. 1 also shows a larger post-centering block 13 and a smaller post-centering block 14 on top of the larger post-centering block 13. These post-centering blocks 13, 14 can be made of plastic, wood or metal. The larger post-centering block 13 represents a centering block for a square post. For example, this larger post-centering block 13 could be the centering block for a 6 inch by 6 inch post which fits on top of the concrete support cylinder made with a Sonotube-type form. Similarly, the smaller post-centering block 14 could be the centering block for a 4 inch by 4 inch post which fits on top of the concrete support cylinder made with a Sonotube-type form. Typically, a smaller post is placed and centered using the smaller block 14 and a larger post is placed and centered using the larger block 13.

Figure 3A:
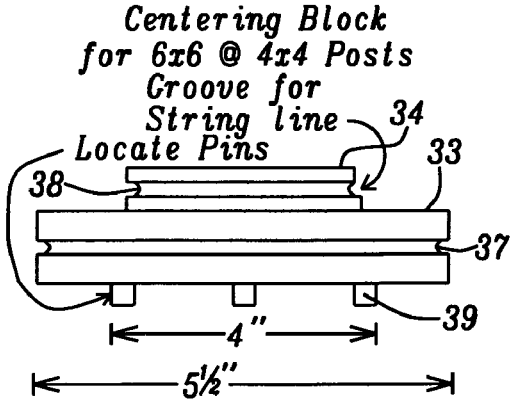
FIG. 3*a* is a side view of the smaller post-centering block on top of the larger post-centering block of the invention.

FIG. 3*a* shows a side view of the two post-centering blocks. The side view of the smaller post-centering block 34 is shown along with its string line groove 38. Similarly, the side view of the larger post-centering block 33 is shown along with its string line groove 37. The underside of the larger post-centering block 33 has 4 locating pegs 39 protruding as shown in the side view of FIG. 3*a* and in the bottom view of FIG. 3*b*.

Figure 2B:
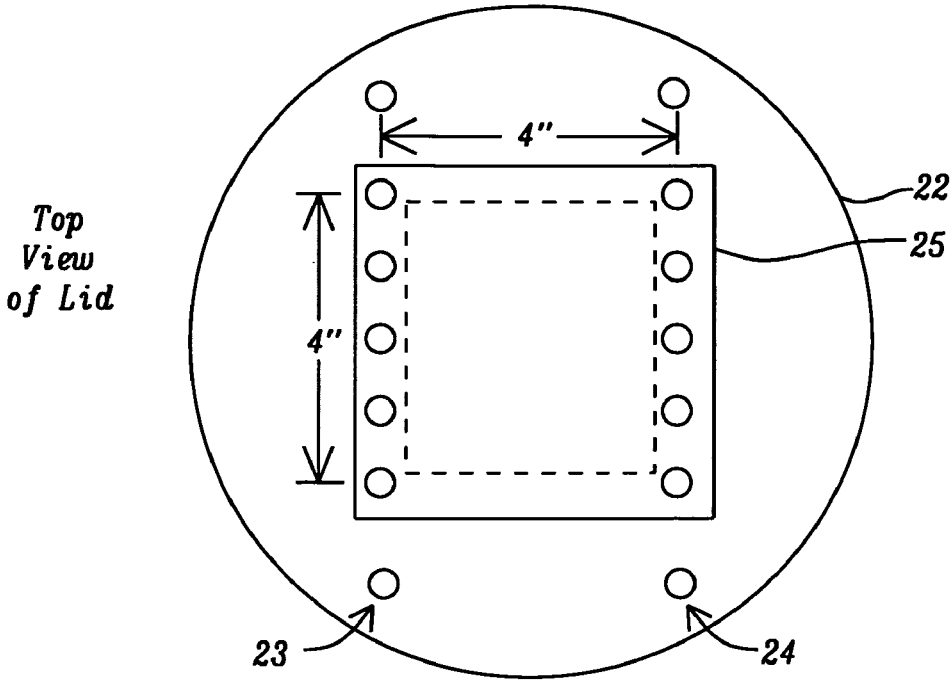
FIG. 2*b* is a top view of a lid adapter showing alignment holes and visible centering square of the invention.

As shown in FIG. 2*a*, the underside of the lid 22 has concentric insert grooves. The other side or top side of the lid 22 has holes which allow the larger post-centering block, which has pegs in its bottom side to insert into these lid holes. The purpose of the larger post-centering block pegs into lid holes structure is to allow the posts to be either centered or off-centered from the center of the concrete pier resulting this concrete form construction methodology. As shown in FIG. 2*b*, the top side of lid 12 in FIG. 1 has two columns 23, 24 of adjusting holes spaced a 2 inches apart in one direction and spaced 4 inches apart in the other direction. This would provide a series of 2-inch adjustments to the edge of the concrete form. In addition, the lid 22 could be rotated in any direction to allow the post to be offset in any direction from the center of the concrete pier. In general, the topside of lid 12 in FIG. 1 has two columns of adjusting holes spaced an M inches apart in one direction and spaced N inches apart in the other direction. This would provide a series of M inch adjustments to the edge of the concrete form, where M and N are positive whole numbers.

Figure 3B:
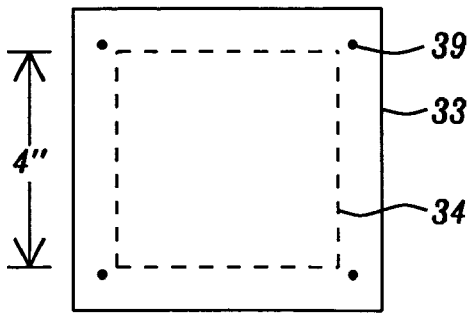
FIG. 3*b* is a bottom view of the smaller post-centering block on top of the larger post-centering block showing the alignment pegs of the invention.

In FIG. 3*b* which shows the bottom view of the larger post-centering block 33, there are 4 locating pins in each corner spaced 4 inches apart. These 4 locating pins can be inserted into the locating holes in the topside of the lid 22 mentioned above. Most project designs will require that the 4 locating pins be placed into the centered square painted 25 on the topside of the lid 22. However, if the project calls for off-centered posts, the 4 locating pins of FIG. 3*b* will be placed into one set of the 2 inch offset holes outside of the painted square 25 shown in FIG. 2*b*. In addition, the lid can be rotated in any direction in order to allow the post to be offset from center in any direction. This invention allows this flexibility.

Figure 4:
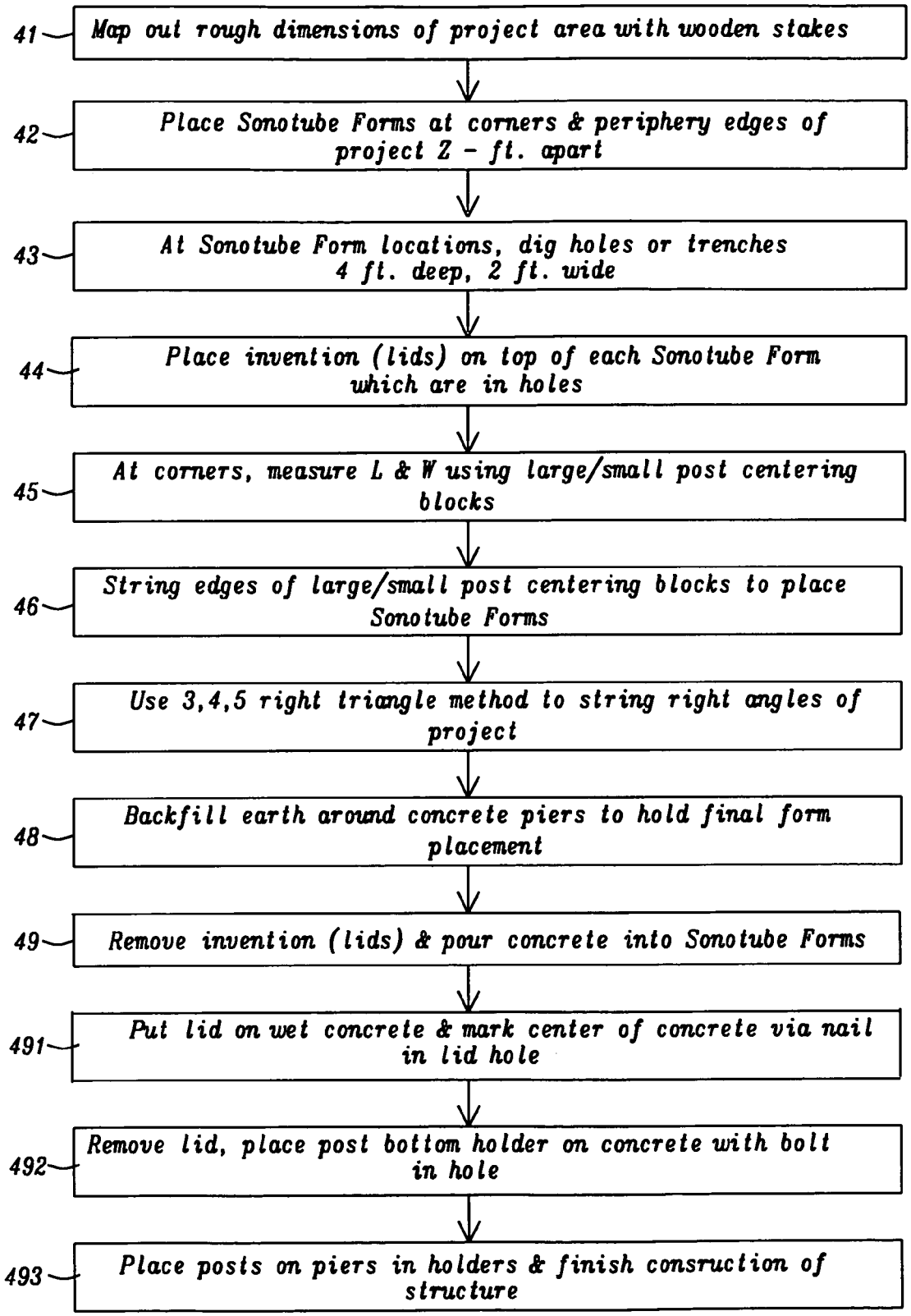
FIG. 4 is a flowchart of the method embodiment of the invention.
Figure 5:
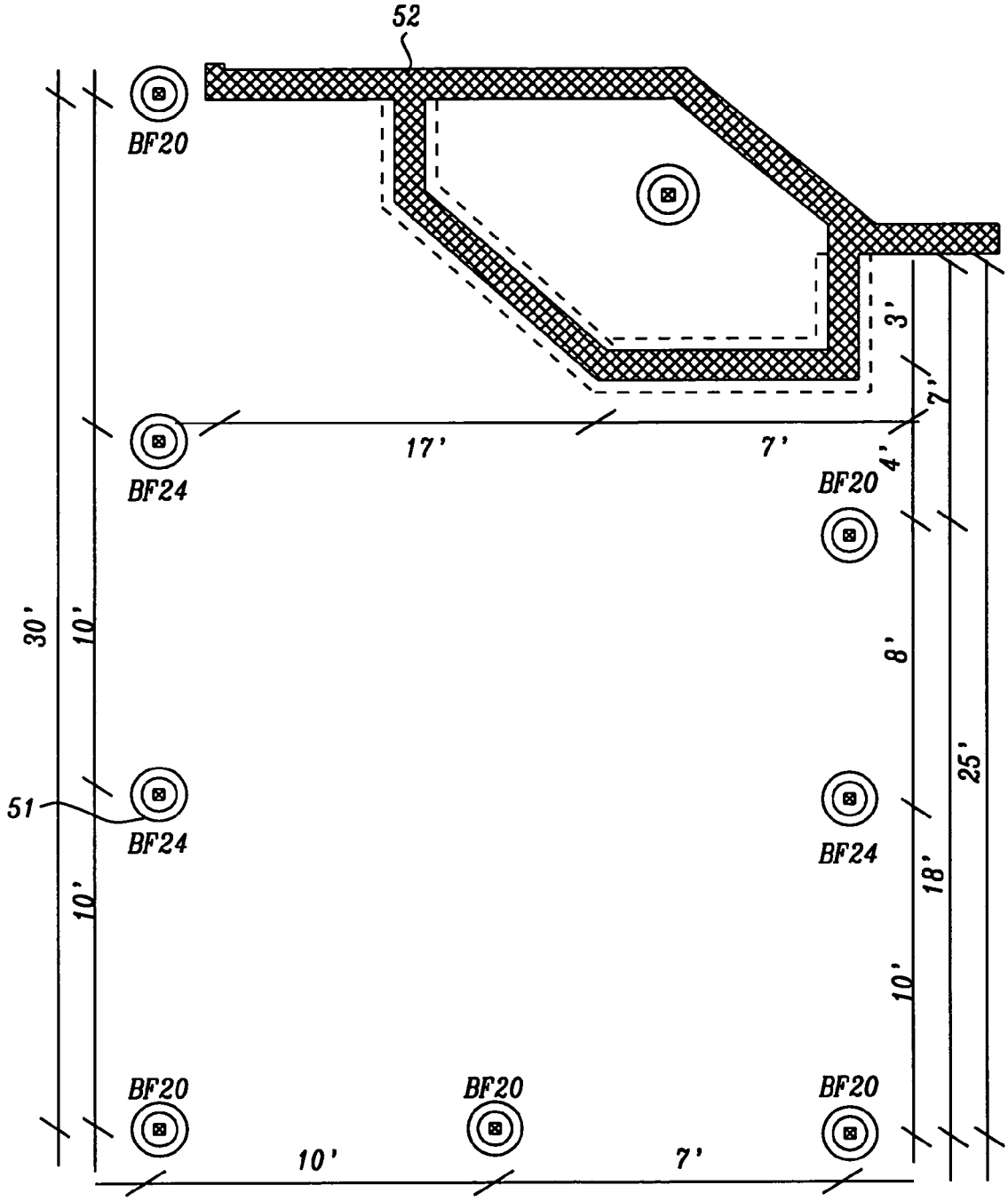
FIG. 5 is a top view of carport project using the invention to align the concrete supports.
Figure 6:
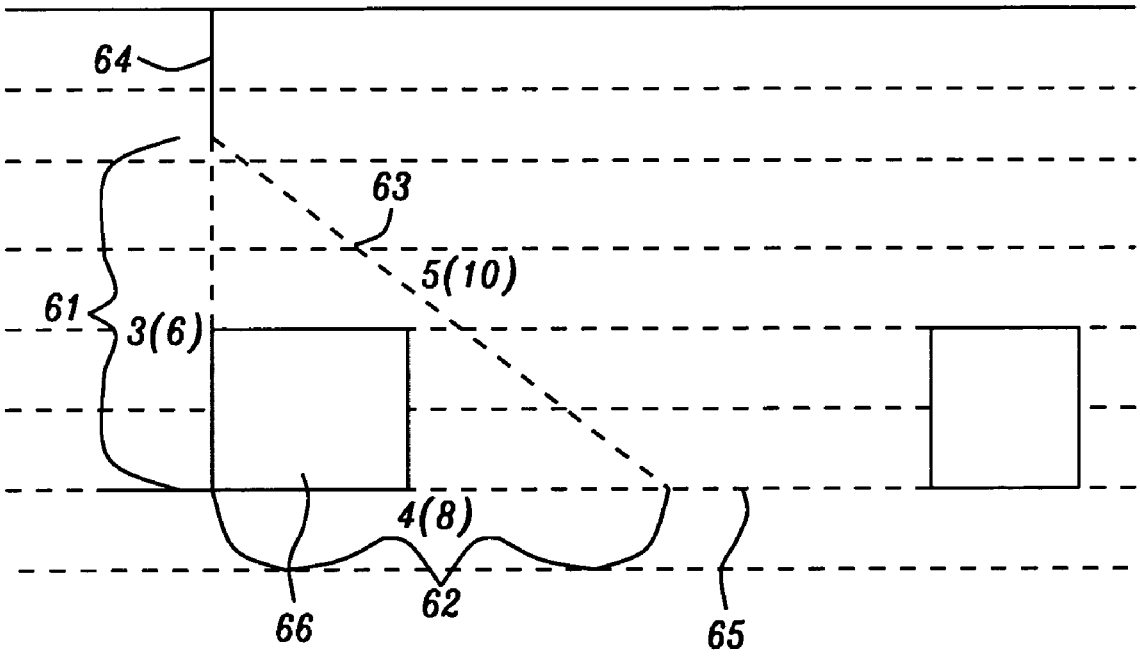
FIG. 6 is a top view of how the top square piece of the invention is used to map out a square edge.

FIG. 4 shows a flowchart of the method embodiment of this invention. The first step shown 41 is to map out the rough dimensions of the project area with wooden stakes. A typical project is shown in FIG. 5. A top view of a carport project is shown. FIG. 5 shows the use of different sizes of Sonotube forms. The second step 42 shown in the FIG. 4 flowchart is to place the Sonotube forms at the corners and periphery edges of the project Z feet apart, where Z is typically a number from 4 to 10. In FIG. 5, a typical Sonotube form 51 is shown. The house or existing building 52 is also shown in FIG. 5. In FIG. 4, the third step 43 is to dig holes or trenches at the Sonotube locations. Typically, these holes are 4 feet deep and 2 feet wide. Next, an invention lid is placed on top of each of the Sonotube forms 44 which have been placed into the holes or trenches. For example, in FIG. 5, eight invention lids would be required. Then, at the corners, the length and width of the project is measured 45 using the edges of either the smaller or larger post-centering blocks on the invention lids. A decision of using either a smaller 4×4 inch post or larger 6×6 inch post would have been previously made. Next, string or rope is placed along the edges 46 of the chosen post-centering block. This string is used to accurately place the corner and edge (between corners) Sonotube forms. Then, at the corners, the 3, 4, 5 right triangle method is used to produce accurate square (90 degree) corners 47. A closer look at this square corner method is shown in FIG. 6, where a measurement of 3 or 6 inches along edge 61 and a measurement of 4 or 8 inches along edge 62 are required to produce a measurement of 5 or 10 inches along edge 63. The placement of the string 64 and 65 and the Sonotube form 66 post-centering block edges along this string require that the measurements of edges 61, 62, and 63 be in a ratio of 3:4:5 in order to guarantee that the Sonotube form placement will result in exact square corners in the final project. Next, backfill the earth around the concrete forms in order to hold their final adjustments in place 48. Next in FIG. 4, the invention lids are removed and concrete is poured into the Sonotube forms 49. Then, while the concrete is still wet, the lids are placed back onto the Sonotube forms 491. During this step, a nail or a bolt is inserted into the center hole in the invention lid to produce a visible center hole and/or spot for bolting a post bottom holder onto the dry concrete column after the drying phase is complete. Next, remove the lid, let the concrete dry. Then, place the post bottom holder on top of the dry solid concrete 492. Bolt the post bottom holder to the center of the concrete column. Finally, place the posts on the piers using the bolted post bottom holders 493 and finish the project construction.

The key advantages of this device and method are as follows. 1) The invention allows the elimination of the trial and error practice in the aligning of wood columns on top of concrete forms. The trial and error is solved by the lid with post-centering blocks which have square edges for placing guide strings at the extreme corners of decks and other concrete support projects. 2) The invention provides the ability to center or off-center posts accurately as required by the project design. 3) The invention provides the ability to accurately set the Sonotube forms for the proper elevation, for the correct location, and for the correct plumb level. 4) The invention eliminates the need for batter boards or wooden edge forms which are placed outside of the project dimensions and used as inaccurate reference points for measuring the placement location of Sonotube forms along the edges of a project area.

While this invention has been particularly shown and described with Reference to the preferred embodiments thereof, it will be understood by those Skilled in the art that various changes in form and details may be made without Departing from the spirit and scope of this invention.

What is claimed is:

1. A concrete form alignment device comprising:

a lid, a larger post-centering block with edge grooves, wherein said larger post-centering block is located on top of said lid, and a smaller post-centering block with edge grooves, wherein said smaller post-centering block is located on top of said larger post-centering block.

2. The concrete form alignment device of claim 1, wherein said lid can be a variety of shapes, such as a circular lid, a square lid or a rectangular lid and has several concentric circular, square or rectangular grooves, respectively, on its bottom side.

3. The concrete form alignment device of claim 2, wherein said concentric grooves fit over different sizes of concrete forms.

4. The concrete form alignment device of claim 1, wherein said lid has two columns of adjusting holes spaced a M inches apart in one direction and spaced N inches apart in the other direction, wherein said two columns of adjusting holes provide a series of M inch adjustments to the edge of the concrete form, where M and N are positive whole numbers, wherein an N by N square shape is visible on the top side of said lid, wherein said square shape is in the center of the top side of said lid.

5. The concrete form alignment device of claim 1, wherein said lid has a single center through-hole which goes completely through said lid.

6. The concrete form alignment device of claim 4, wherein the under side of said larger post centering block has 4 equally-spaced, locating pegs, N inches apart, centered on the bottom side of said larger post centering block.

7. The concrete form alignment device of claim 6, wherein said 4 equally-spaced, locating pegs on the under side of said larger post centering block fits into said N by N square shape which is visible on the top side of said lid, to allow said post on a resultant concrete pier to be centered.

8. The concrete form alignment device of claim 6, wherein said 4 equally-spaced, locating pegs on the under side of said larger post centering block fits into said adjusting holes some of which are outside of said N by N square shape which is visible on the top side of said lid, to allow said post on a resultant concrete pier of be off-centered, wherein said lid can be rotated to allow said post on said resultant concrete pier to be off-centered in any direction.

9. The concrete form alignment device of claim 1, wherein said edge grooves are used to align said concrete forms and to produce accurate right angles at a project's corners.

10. The concrete form alignment device of claim 5, wherein said single through-hole in said lid is used to mark a center bolt hole while concrete is still wet, wherein said bolt hole is later used to attach a post bottom holder.

11. A method of aligning concrete forms comprising the steps of:

providing a lid, providing a larger post-centering block with edge grooves, wherein said larger post-centering block is located on top of said lid, and providing a smaller post-centering block with edge grooves, wherein said smaller post-centering block is located on top of said larger post-centering block.

12. The method of aligning concrete forms of claim 11, wherein said lid can be a variety of shapes, such as a circular lid, a square lid or a rectangular lid and has several concentric circular, square or rectangular grooves, respectively, on its bottom side.

13. The method of aligning concrete forms of claim 12, wherein said concentric grooves fit over different sizes of concrete forms.

14. The method of aligning concrete forms of claim 11, wherein said lid has two columns of adjusting holes spaced a M inches apart in one direction and spaced N inches apart in the other direction, wherein said two columns of adjusting holes provide a series of M inch adjustments to the edge of the concrete form, where M and N are positive whole numbers, wherein an N by N square shape is visible on the top side of said lid, wherein said square shape is in the center of the top side of said lid.

15. The method of aligning concrete forms of claim 11, wherein said lid has a single center through-hole which goes completely through said lid.

16. The method of aligning concrete forms of claim 14, wherein the under side of said larger post centering block has 4 equally-spaced, locating pegs, N inches apart, centered on the bottom side of said larger post centering block.

17. The method of aligning concrete forms of claim 16, wherein said 4 equally-spaced, locating pegs on the under side of said larger post centering block fits into said N by N square shape which is visible on the top side of said lid, to allow said post on a resultant concrete pier to be centered.

18. The method of aligning concrete forms of claim 16, wherein said 4 equally-spaced, locating pegs on the under side of said larger post centering block fits into said adjusting holes some of which are outside of said N by N square shape which is visible on the top side of said lid, to allow said post on a resultant concrete pier of be off-centered, wherein said lid can be rotated to allow said post on said resultant concrete pier to be off-centered in any direction.

19. The method of aligning concrete forms of claim 11, wherein said edge grooves are used to align said concrete forms and to produce accurate right angles at a project's corners.

20. The method of aligning concrete forms of claim 15, wherein said single through-hole in said lid is used to mark a center bolt hole while concrete is still wet, wherein said bolt hole is later used to attach a post bottom holder.

* * * * *